US009895034B1

(12) United States Patent
Maurras

(10) Patent No.: US 9,895,034 B1
(45) Date of Patent: Feb. 20, 2018

(54) HAND-HELD URINAL WITH STABILIZING MECHANISM

(71) Applicant: Kathy H. Maurras, N. Providence, RI (US)

(72) Inventor: Kathy H. Maurras, N. Providence, RI (US)

( * ) Notice: Subject to any disclaimer, the term of this patent is extended or adjusted under 35 U.S.C. 154(b) by 0 days.

(21) Appl. No.: 15/407,321

(22) Filed: Jan. 17, 2017

(51) Int. Cl.
*A47K 11/00* (2006.01)
*A47K 11/12* (2006.01)
*A61G 9/00* (2006.01)

(52) U.S. Cl.
CPC ..... *A47K 11/12* (2013.01); *A61G 9/003* (2013.01); *A61G 9/006* (2013.01)

(58) Field of Classification Search
CPC ..... A47K 11/12; A61G 9/006; A61G 9/003
See application file for complete search history.

(56) References Cited

U.S. PATENT DOCUMENTS 2,522,273 A * 9/1950 Johnson ..... A61G 9/006 4/144.1
2,687,534 A * 8/1954 Johnson ..... A61G 9/006 292/246
D399,308 S 10/1998 Garlock
5,926,858 A 7/1999 Heller
5,953,763 A 9/1999 Gouget
6,119,280 A 9/2000 Rentsch
6,941,587 B1 9/2005 Fletcher
2003/0074724 A1 4/2003 Sands
2004/0003457 A1 1/2004 Renda
2006/0277670 A1* 12/2006 Baker ..... A61G 9/00 4/144.1
2009/0036848 A1* 2/2009 Faiola ..... A61G 9/006 604/329
2012/0199715 A1* 8/2012 Tuell ..... A61G 7/0503 248/311.2
2016/0157684 A1* 6/2016 Helfrich ..... A47K 13/10 4/246.3

FOREIGN PATENT DOCUMENTS

WO 2013001291 A1 1/2013

* cited by examiner

*Primary Examiner* — J. Casimer Jacyna

(57) ABSTRACT

The hand-held urinal with stabilizing mechanism is a hand-held collection device that comprises a medical urinal, weight bar, and a semi-rigid connector. The medical urinal is modified through the addition of the weight bar and the semi-rigid connector. The weight bar and the semi-rigid connector act as a counterbalance that adjusts the location of the first moment of the hand-held urinal with stabilizing mechanism relative to the first moment of just the medical urinal. The addition of the weight bar and the semi-rigid connector reduces the change in the first moment of the hand-held urinal with stabilizing mechanism that is caused by the addition of urine to the medical urinal during the use of the hand-held urinal with stabilizing mechanism. This makes the hand-held urinal with stabilizing mechanism easier to hold during the collection of urine.

5 Claims, 2 Drawing Sheets

HAND-HELD URINAL WITH STABILIZING MECHANISM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including an accommodation for a patient, more specifically, a bed pan, urinal, or other sanitary device.

SUMMARY OF INVENTION

The hand-held urinal with stabilizing mechanism is adapted for use in collecting urine from a human being. The hand-held urinal with stabilizing mechanism is a hand-held collection device that comprises a medical urinal, weight bar, and a semi-rigid connector. The medical urinal is commercially available device that is further defined with a bottle, a neck, a cap, and a handle. The medical urinal is modified through the addition of the weight bar and the semi-rigid connector. The weight bar and the semi-rigid connector act as a counterbalance that adjusts the location of the first moment (often informally called the center of gravity) of the hand-held urinal with stabilizing mechanism relative to the first moment of just the medical urinal. The addition of the weight bar and the semi-rigid connector reduces the change in the first moment of the hand-held urinal with stabilizing mechanism that is caused by the addition of urine to the medical urinal during the use of the hand-held urinal with stabilizing mechanism. This reduction in the change of the first moment increases the stability of the hand-held urinal with stabilizing mechanism which makes the hand-held urinal with stabilizing mechanism easier to hold during the collection of urine.

These together with additional objects, features and advantages of the hand-held urinal with stabilizing mechanism will be readily apparent to those of ordinary skill in the art upon reading the following detailed description of the presently preferred, but nonetheless illustrative, embodiments when taken in conjunction with the accompanying drawings.

In this respect, before explaining the current embodiments of the hand-held urinal with stabilizing mechanism in detail, it is to be understood that the hand-held urinal with stabilizing mechanism is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hand-held urinal with stabilizing mechanism.

It is therefore important that the claims be regarded as including such equivalent construction insofar as they do not depart from the spirit and scope of the hand-held urinal with stabilizing mechanism. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
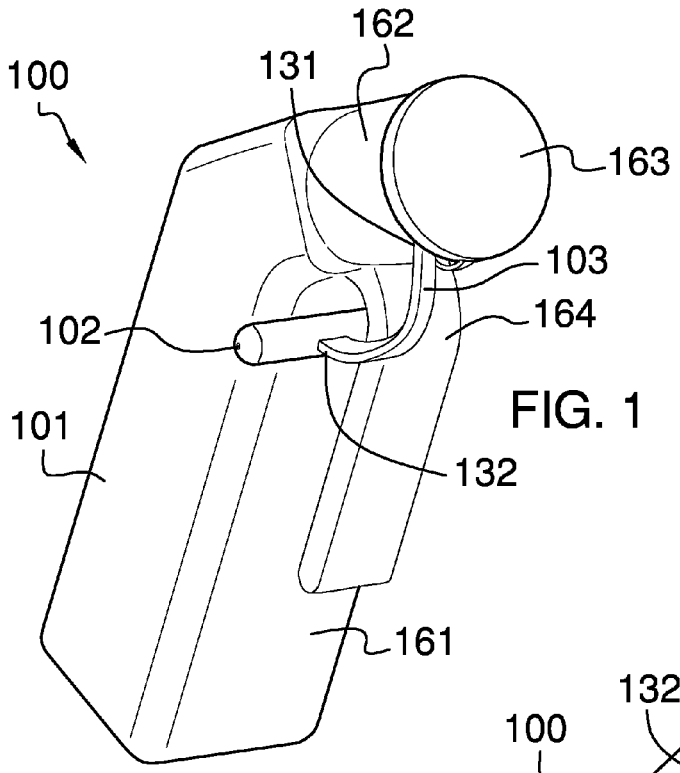
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The hand-held urinal with stabilizing mechanism 100 (hereinafter invention) is adapted for use in collecting urine 165 from a human being. The invention 100 is a hand-held collection device that comprises a medical urinal 101, weight bar 102, and a semi-rigid connector 103. The medical urinal 101 is a commercially available device that is further defined with a bottle 161, a neck 162, a cap 163, and a handle 164. The medical urinal 101 is modified through the addition of the weight bar 102 and the semi-rigid connector 103. The weight bar 102 and the semi-rigid connector 103 act as a counterbalance that adjusts the location of the first moment (often informally called the center of gravity) of the invention 100 relative to the first moment of just the medical urinal 101. The addition of the weight bar 102 and the semi-rigid connector 103 reduces the change in the first moment of the invention 100 that is caused by the addition of urine 165 to the medical urinal 101 during the use of the invention 100. This reduction in the change of the first moment increases the stability of the invention 100 which makes the invention 100 easier to hold during the collection of urine 165.

The medical urinal 101 is a readily and commercially available hand-held urine 165 collection device that is used for the purpose of: 1) accommodating the biological needs of non-ambulatory patients; or, 2) for measuring the volume of urine 165 discharge of a patient. The medical urinal 101 is further defined with a bottle 161, a neck 162, a cap 163, and a handle 164. The medical urinal 101 receives a urine 165 stream through the neck 162. The urine 165 stream is stored within the interior of the bottle 161. The bottle 161 is sealed with a cap 163. In the first potential embodiment of the disclosure, the handle 164 is a structure that is attached to the exterior surface of the bottle 161 for the purpose of manipulating the invention 100 by hand.

The weight bar 102 is a cylindrically shaped structure that provides the mass that is used to alter the location of the first moment of the invention 100 relative to the first moment of the medical urinal 101. The weight bar 102 mitigates the changes to the first moment of the invention 100 caused by the addition of urine 165 to the bottle 161 through two mechanisms. In the first mechanism, the additional mass of the weight bar 102 decreases the proportion of the mass of the urine 165 relative the mass of the invention 100 compared to the mass of the urine 165 relative the mass of the medical urinal 101 alone. This proportional decrease makes the invention 100 less sensitive to the mass changes caused by the urine 165 relative to a similar mass sensitivity of the medical urinal 101. In the second mechanism, the weight bar 102 is attached to the medical urinal 101 in a dynamic manner that allows the weight bar 102 to move relative to the medical urinal 101. Specifically, the as the force of gravity applied to the additional mass of the urine 165 causes the location of the first moment of the invention 100 to move relative to the location of the initial first moment, the weight bar 102 will move in reaction to the gravitation forces in a manner that counteracts or inhibits the shift in the first moment thereby increasing the stability of the invention 100. The dynamic attachment mechanism is provided by the semi-rigid connector 103 and is discussed elsewhere in this disclosure.

The weight bar 102 further comprises a metal cylinder 111 and a protective skin 112. The metal cylinder 111 is a cylindrical structure that is formed from a metal. The use of a high density metal, including but not limited to, steel, iron, or lead is preferred. The protective skin 112 is a coating that is applied to the metal cylinder 111. The purpose of the protective skin 112 is to: 1) protect the metal cylinder 111 from corrosion; and, 2) to prevent the metal forming the metal cylinder 111 from leeching into the environment. Methods to form metal cylinders 111 and to coat metal cylinders 111 are well known and documented in the metal working arts.

Figure 2:
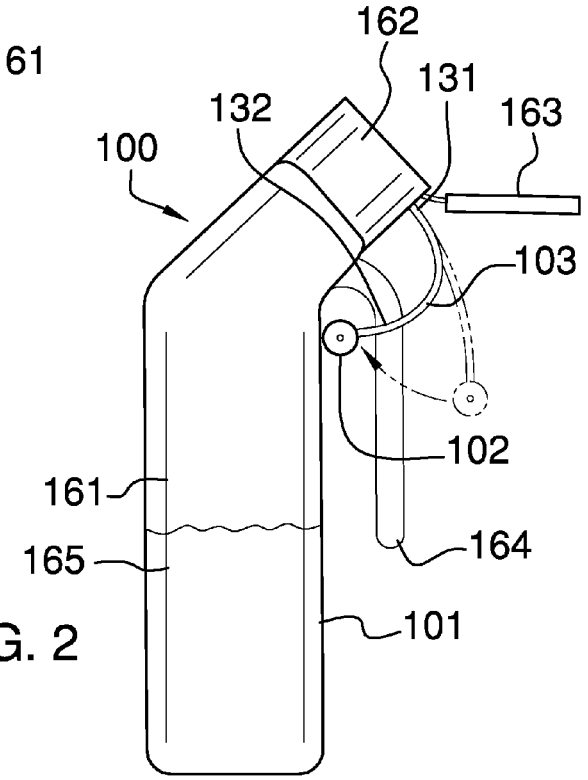
FIG. 2 is a side view of an embodiment of the disclosure.
Figure 3:
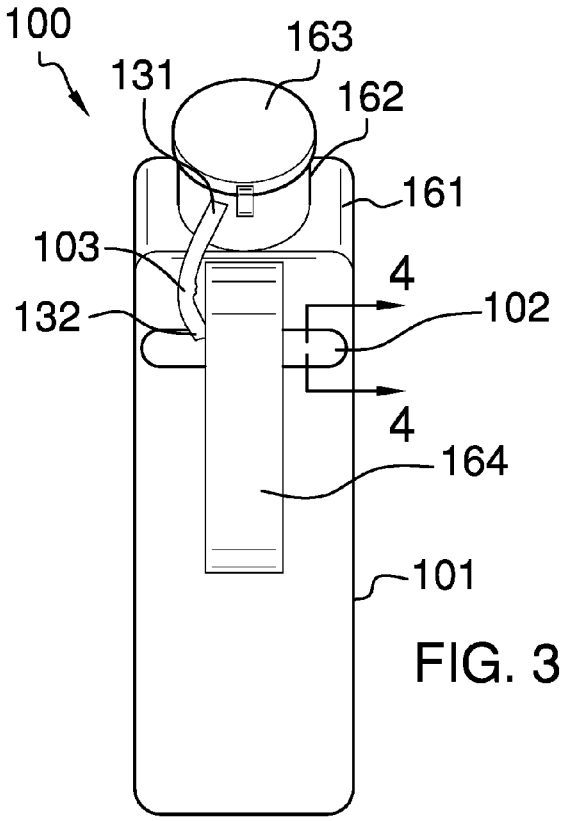
FIG. 3 is a front view of an embodiment of the disclosure.
Figure 4:
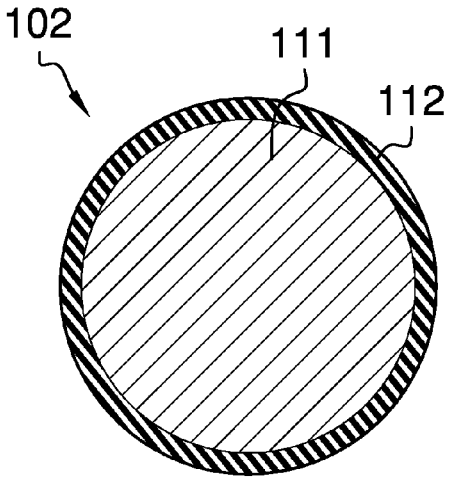
FIG. 4 is a cross-sectional view of an embodiment of the disclosure across 4-4 as shown in FIG. 3.

As shown most clearly in FIG. 2, the semi-rigid connector 103 is a curved rectangular bar that connects the bottle 161 of the medical urinal 101 to the weight bar 102. The semi-rigid connector 103 is formed from a semi-rigid material that has an elastic nature. The semi-rigid connector 103 is further defined with a first end 131 and a second end 132. The first end 131 attaches to the medical urinal 101 in the manner of a cantilever. The second end 132 of the semi-rigid connector 103 attaches to the weight bar 102 in such a manner that a straight line drawn between the center point of the semi-rigid connector 103 and the center point of the weight bar 102 will perpendicularly intersect the center axis of the metal cylinder 111. Because the weight bar 102 has no other points of attachment the combination of the weight bar 102 and the semi-rigid connector 103 will be treated as a cantilever.

The semi-rigid connector 103 acts as a spring. Specifically, when a force is applied perpendicularly to the center axis of the semi-rigid connector 103, the elasticity of the semi-rigid connector 103 creates a force that opposes the displacement created by the force applied the semi-rigid connector 103. The displacing force places a strain on the semi-rigid connector 103 creating an opposing force within the semi-rigid connector 103 such that the opposing force of the strain is in the direction that returns the semi-rigid connector 103 to its relaxed shape. More specifically, when a force is applied to the cantilever, the elasticity of the cantilever creates a rotational torque that opposes the displacement created by rotating the cantilever around a pivot point located at the first end 131 where the cantilever is attached to the receptacle. This rotational torque places a strain on the cantilever such that the force of the strain is in the direction that returns the cantilever to its original position. The curve formed in the semi-rigid connector 103 is designed to increase this spring like operation through all potential orientations of the invention 100 relative to the force of gravity. Methods to form cantilevers that perform the functions of a spring are well known and documented in the mechanical arts.

The theory of the mechanism of operation of the invention 100 is described in this paragraph. When the invention 100 is held by hand during use, the addition of a mass of urine 165 to the medical urinal 101 will cause the orientation of the invention 100 relative to the force of gravity to shift. The liquid nature of the contents within the interior of the medical urinal 101 cause a change in the orientation of the invention 100 relative to the force of gravity which will further cause a shift in the first moment of the invention 100. However, the shift in the orientation of the invention 100 relative to the force of gravity to shift further causes a shift in the orientation of the weight bar 102 and the semi-rigid connector 103 relative to the force of gravity. This change in orientation of the weight bar 102 and the semi-rigid connector 103 counterbalances the change in the first moment caused by the additional mass of urine 165 thereby maintaining the first moment in its original location and keeping the invention 100 stable.

As shown most clearly in FIG. 2, the invention 100 is stored with the weight bar 102 located between the handle 164 and the bottle 161. To use the invention 100, the semi-rigid connector 103 is deformed such that the weight bar 102 is brought to the side of the handle 164 that is distal from the bottle 161 such that the weight bar 102 and the semi-rigid connector 103 can move freely. The invention 100 is then used in a normal manner. After use, the weight bar 102 is then returned to the space between the bottle 161 and the handle 164.

The following definitions were used in this disclosure:

Cantilever: As used in this disclosure, a cantilever is a beam or other structure that projects away from an object and is supported on only one end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is use as a relational term that implies that an object is not contained within the boundary of a structure or a space.

Hand-held: As used in this disclosure, when referring to an item or device, hand-held means that the item or device is small and light enough to be operated while a person holds the item or device in their hands.

Interior: As used in this disclosure, the interior is use as a relational term that implies that an object is contained within the boundary of a structure or a space.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A sanitary device for the collection of urine comprising:
- a medical urinal, weight bar, and a semi-rigid connector;
- wherein the sanitary device for the collection of urine is a hand-held collection device;
- wherein the sanitary device for the collection of urine is adapted for use in collecting urine from a human being;
- wherein the medical urinal is further defined with a bottle, a neck, a cap, and a handle;
- wherein the medical urinal is modified through the attachment of the weight bar and the semi-rigid connector;
- wherein the weight bar and the semi-rigid connector acts as a counterbalance that adjusts the location of the first moment of the sanitary device for the collection of urine relative to the first moment of just the medical urinal;
- wherein the addition of the weight bar and the semi-rigid connector reduces the change in the first moment of the sanitary device for the collection of urine that is caused by the addition of urine to the medical urinal during the use of the sanitary device for the collection of urine;
- wherein the medical urinal is hand-held urine collection device;
- wherein the medical urinal receives the urine stream through the neck;
- wherein the urine stream is stored within the interior of the bottle;
- wherein the bottle is sealed with a cap;
- wherein the handle is a structure that is attached to the exterior surface;
- wherein the weight bar is a cylindrically shaped structure;
- wherein the weight bar is attached to the medical urinal in a dynamic manner;
- wherein the dynamic manner of attachment causes the weight bar will move in reaction to the gravitation forces in a manner that inhibits shift in the location of the first moment of the sanitary device for the collection of urine;
- wherein the dynamic manner of attachment is provided by the semi-rigid connector;
- wherein the weight bar further comprises a metal cylinder and a protective skin;
- wherein the protective skin is a coating that is applied to the metal cylinder;
- wherein the metal cylinder is a cylindrical structure;
- wherein the metal cylinder is formed from a metal;
- wherein the metal is selected from the group consisting of steel, iron, or lead;
- wherein the semi-rigid connector is a curved rectangular bar;
- wherein the semi-rigid connector attaches the bottle of the medical urinal to the weight bar.

2. The sanitary device for the collection of urine according to claim 1
- wherein the semi-rigid connector is formed from a semi-rigid material that has an elastic nature;
- wherein the semi-rigid connector is further defined with a first end and a second end.

3. The sanitary device for the collection of urine according to claim 2 wherein the first end attaches to the medical urinal in the manner of a cantilever.

4. The sanitary device for the collection of urine according to claim 3 wherein the second end of the semi-rigid connector attaches to the weight bar in such a manner that a straight line drawn between the center point of the semi-rigid connector and the center point of the weight bar will perpendicularly intersect the center axis of the metal cylinder.

5. The sanitary device for the collection of urine according to claim 4 wherein the semi-rigid connector acts as a spring;

wherein the elasticity of the semi-rigid connector creates a force that opposes any displacement forces applied the semi-rigid connector;

wherein the opposing force created within the semi-rigid connector is in the direction that returns the semi-rigid connector to its relaxed shape.

* * * * *